United States Patent [19]

Martinez Llaneza

[11] Patent Number: 4,603,630

[45] Date of Patent: Aug. 5, 1986

[54] MACHINE FOR CONTINUOUSLY PERFORATING WIDE PAPER

[75] Inventor: Manuel Martinez Llaneza, Madrid, Spain

[73] Assignee: Investronica, S.A., Madrid, Spain

[21] Appl. No.: 620,731

[22] Filed: Jun. 13, 1984

[30] Foreign Application Priority Data

Jun. 16, 1983 [ES] Spain ..... 523.343

[51] Int. Cl.[4] ..... B41F 13/56

[52] U.S. Cl. ..... 101/227; 83/336; 242/56.8; 242/57; 242/75.44

[58] Field of Search ..... 83/336, 308, 678, 57, 83/74, 175, 345; 242/56.8, 75.2, 56 R, 57, 75.44; 101/224, 226, 227, 228, 36, 37; 33/34, 37

[56] References Cited

U.S. PATENT DOCUMENTS

| | | | |
|---|---|---|---|
| 236,068 | 12/1880 | Newcomb | 242/75.2 |
| 553,356 | 1/1896 | McAdams | 33/37 |
| 885,114 | 4/1908 | Waring | 242/56 R |
| 1,158,767 | 11/1915 | Amrhein | 242/56.8 X |
| 1,958,717 | 5/1934 | Schake et al. | 101/36 |
| 3,087,248 | 4/1963 | Martin | 33/34 |
| 3,113,513 | 12/1963 | Coulter | 33/37 X |
| 3,174,428 | 3/1965 | Huck | 83/345 X |
| 3,186,443 | 6/1965 | Budzyna | 242/75.2 X |
| 3,832,925 | 9/1974 | Brandt et al. | 83/345 X |
| 3,995,791 | 12/1976 | Schoppee | 242/75.44 X |

*Primary Examiner*—Clifford D. Crowder

*Attorney, Agent, or Firm*—Wenderoth, Lind & Ponack

[57] ABSTRACT

A machine for continuously laterally perforating very wide paper and having an electronic control for smoothly starting and stopping the paper, a length of perforated paper detection device and combined control warning device for detecting the end of the roll of paper, wherein the machine is arranged in a compact structure having two simultaneously mechanized lateral holders which support all of the various mechanisms so as to thereby ensure the perfect positioning thereof. The actuation of the perforator heads of the machine is effected by the paper itself through a precision mechanized antiskid roller and the tension of the paper is controlled by swinging rollers whose movement is detected by a sensor and electronically processed while simultaneously taking into consideration the speed of the paper so as to control the unwinding of the feed roll of paper utilizing an electromagnet brake.

1 Claim, 6 Drawing Figures

MACHINE FOR CONTINUOUSLY PERFORATING WIDE PAPER

BACKGROUND AND SUMMARY OF THE INVENTION

The present invention, as disclosed herein, comprises a machine that is capable of continuously laterally perforating very wide paper, for its subsequent use on a drawing plotter. The perforations enable the paper to be fed by the plotter using lugs which engage the perforations.

In order to perform said operation, the machine has a smooth start and stop electronic control, a length of perforated paper detection device and combined control warning device for detecting the end of the roll.

Paper perforated laterally is widely used in a broad range of printers. To perforate such paper, there are machines which, in general, perforate at the same time as they perform other functions, such as: ruling, printing, folding, etc. But such machines always deal with very narrow paper (approximately 0.5 meters).

The perforation of very wide paper (about 2 meters) for drawing plotters poses a specific problem. On the one hand, the usual speeds and tensions in machines for narrow paper are not acceptable, because these produce creases, misalignment and tearing in wide paper. On the other hand, the fact that other functions are not required allows a simplification of some aspects of conventional machines. Lastly, the short length of the rolls and the flexibility of the mandrels for drawing plotters imposes specific use conditions.

All this makes machines that continuously perforate wide paper virtually unknown, and only intermittent, very expensive and slow machines predominate.

Among the outstanding characteristics of a machine in accordance with the present invention and one which gives it a high priority over the prior art is the fact that an appreciable reduction in the operation cost and a high degree of output can be obtained.

The machine basically consists of a system that causes the paper to travel by means of an electronically controlled servomotor. The drag of the paper itself releases the set of perforator heads through an antiskid roller. A paper feed coil is provided with a similar electronically-controlled brake of a dynamic form. A rigid mandrel is provided for receiving the perforated paper. A lateral stamping system is provided for periodically printing a mark or symbol on the paper.

The entire machine is mounted on a compact structure wherein two simultaneously integral lateral holders support and ensure perfect positioning of the elements.

BRIEF DESCRIPTION OF THE DRAWINGS

Additional objects and advantages of the invention will become apparent as the following detailed description of the invention is read in conjunction with the accompanying drawings which illustrate the invention in an illustrative and non-limitative manner.

DESCRIPTION OF THE PREFERRED EMBODIMENT

Figure 1:
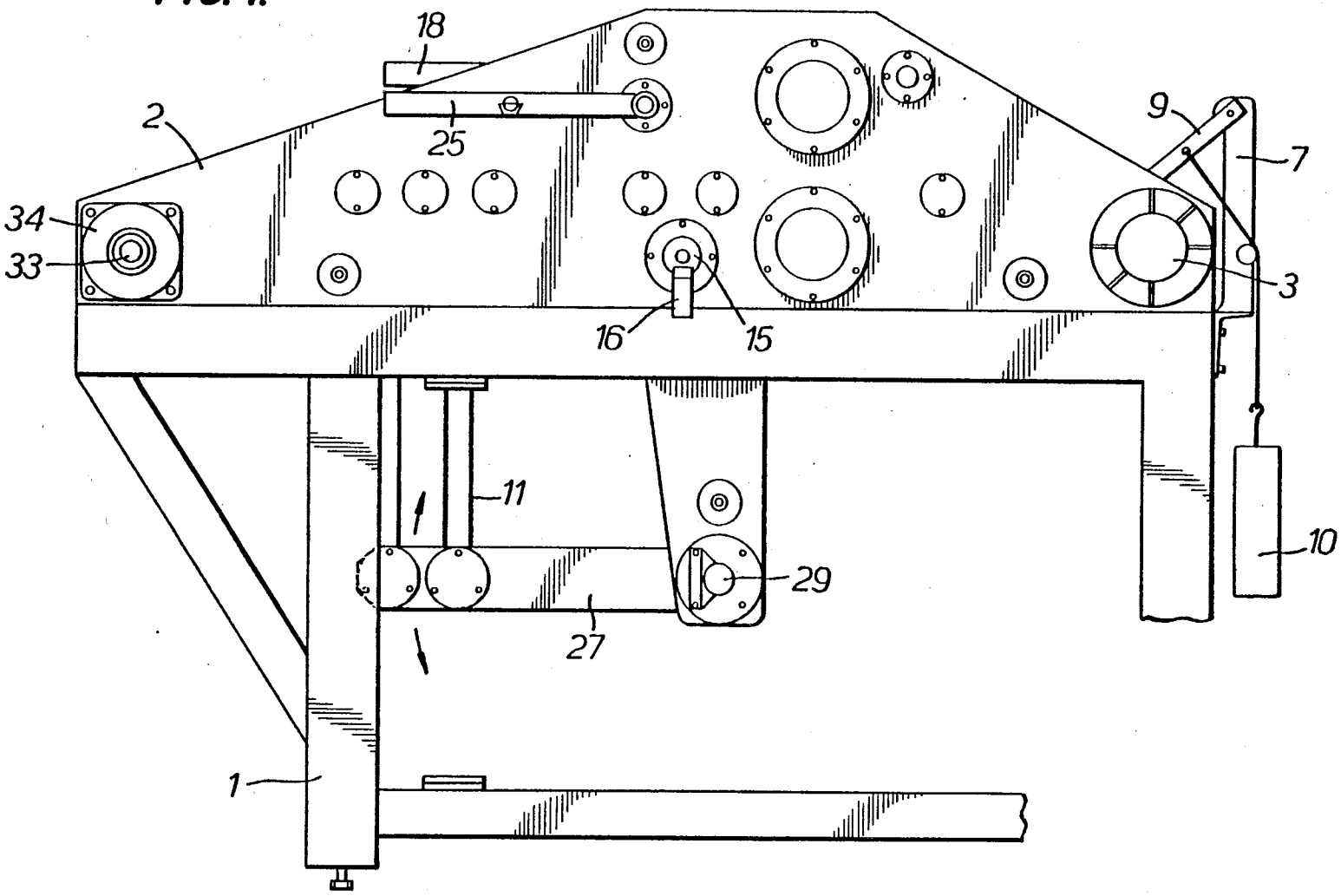
FIG. 1 is a side view of the machine without frames.
Figure 2:
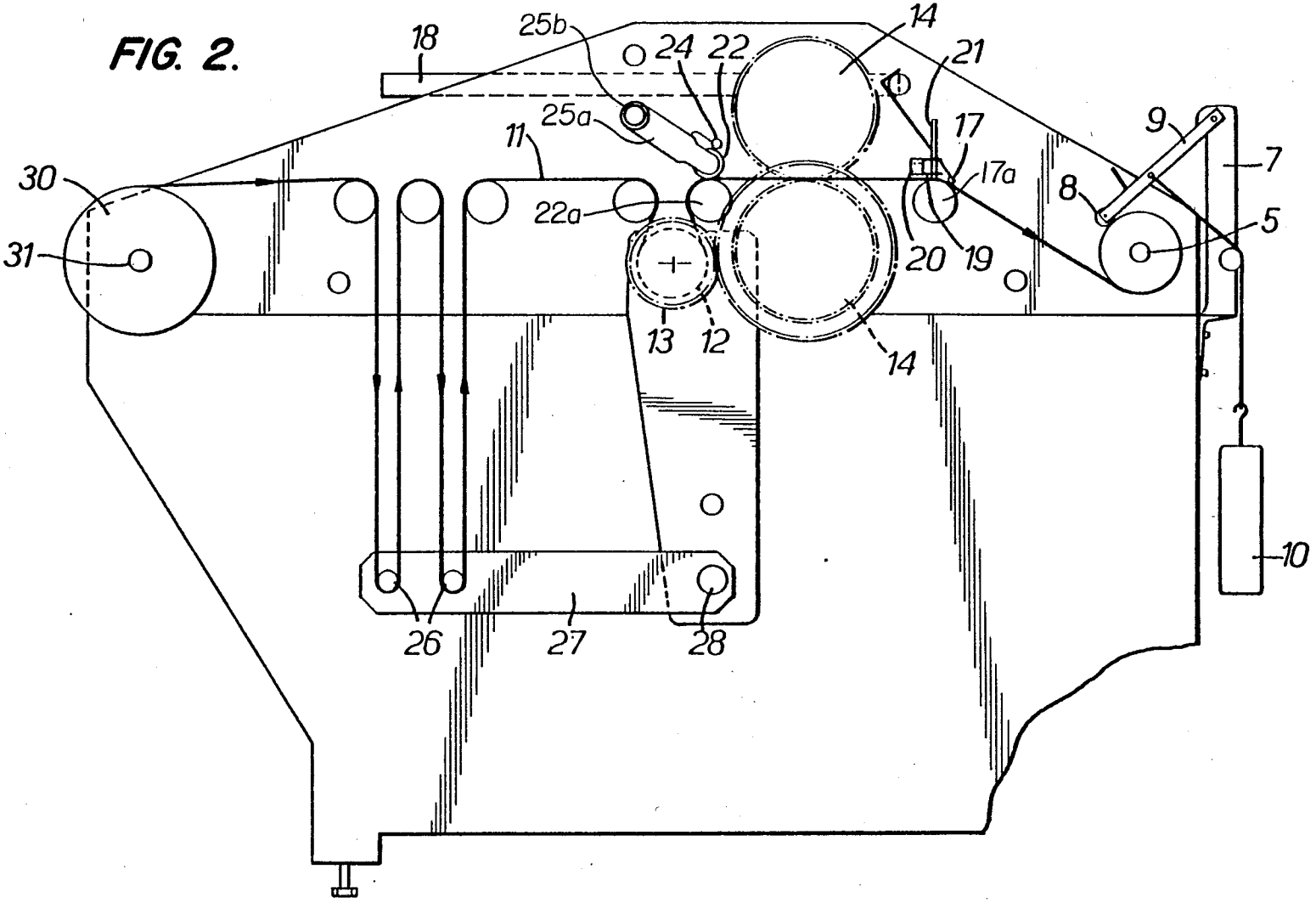
FIG. 2 is the same side view of FIG. 1 wherein the holder has been made transparent to show the different mechanisms.
Figure 3:
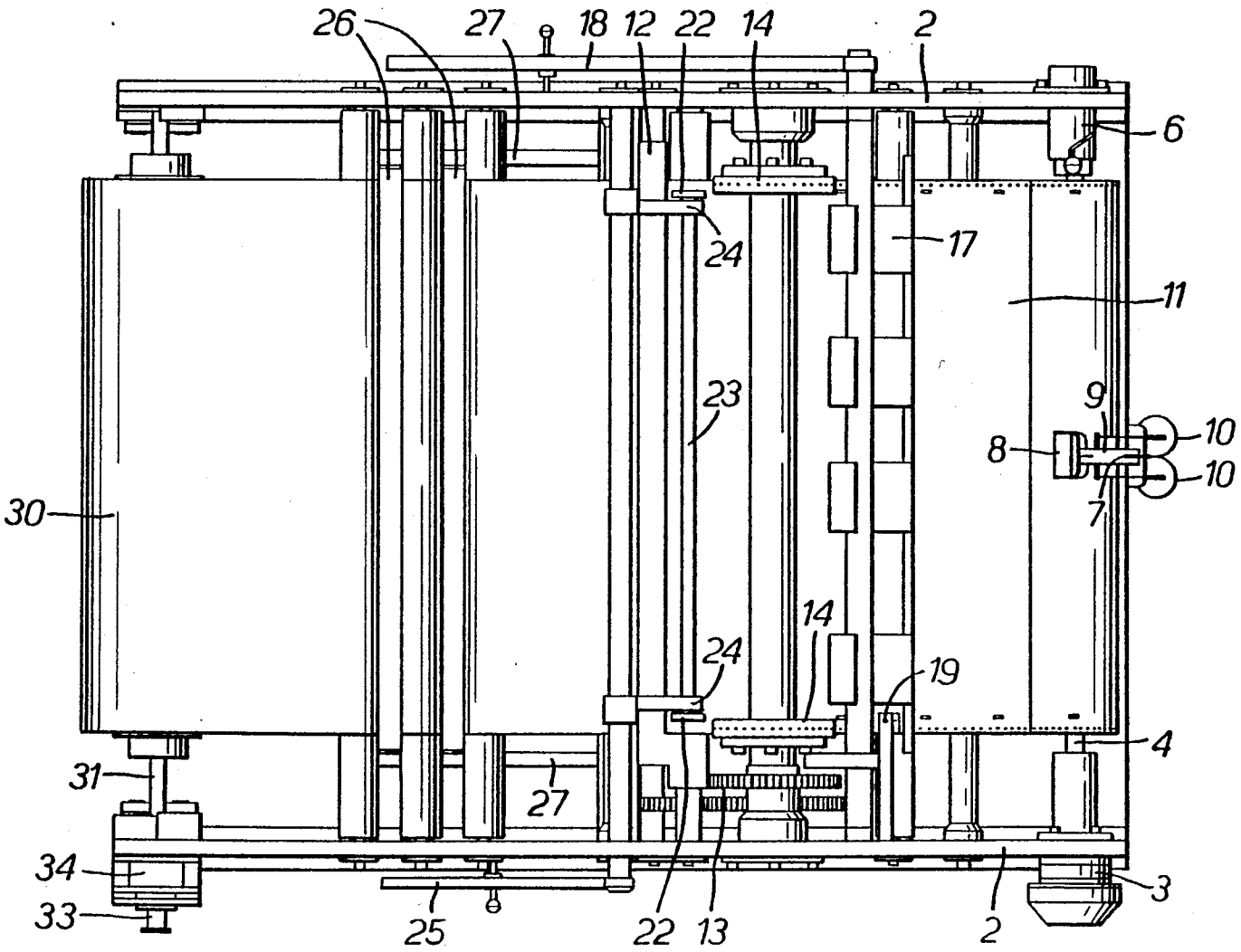
FIG. 3 is a plan view of the machine.
Figure 4:
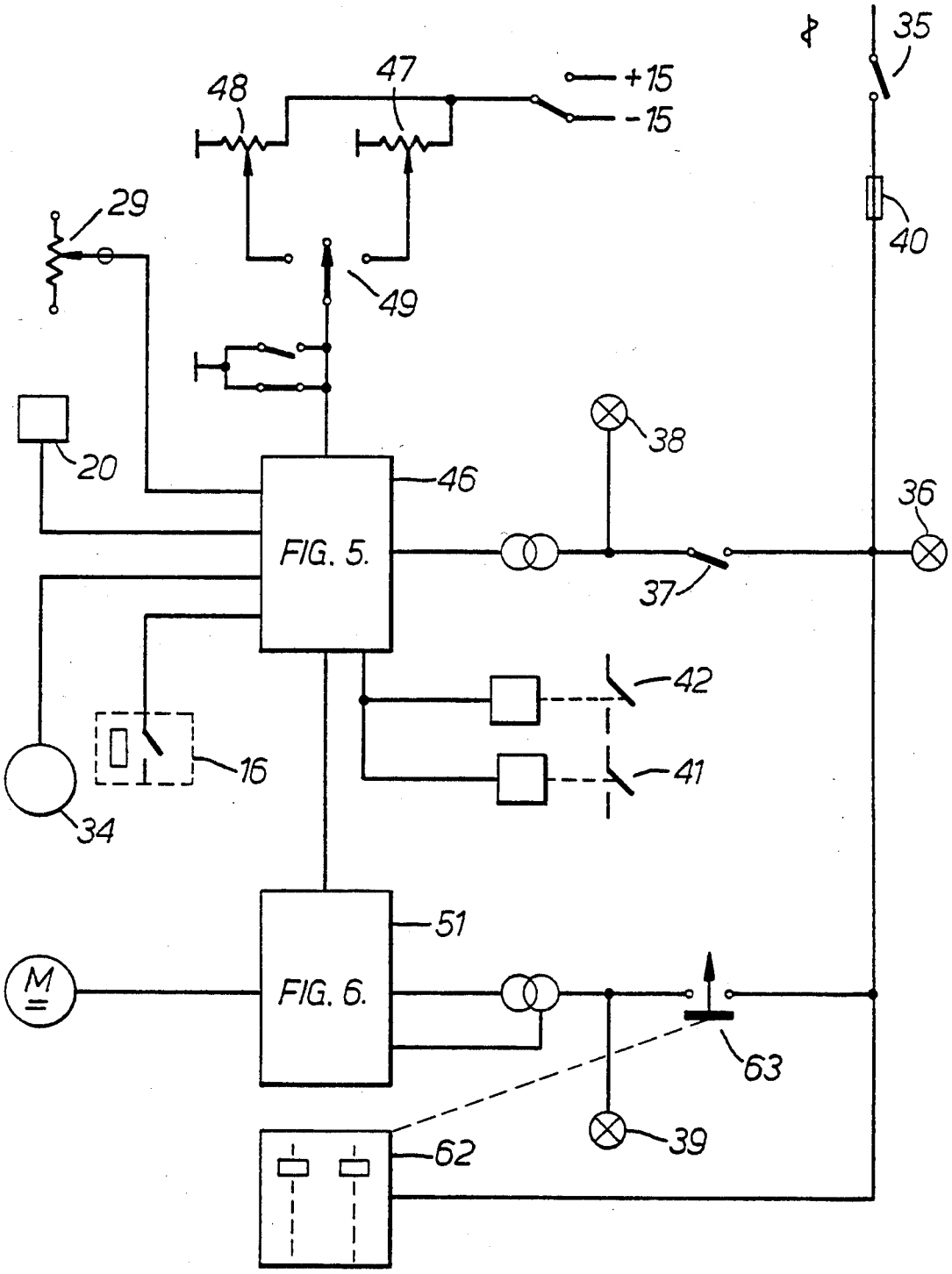
FIG. 4 is a block diagram of the control system.
Figure 5:
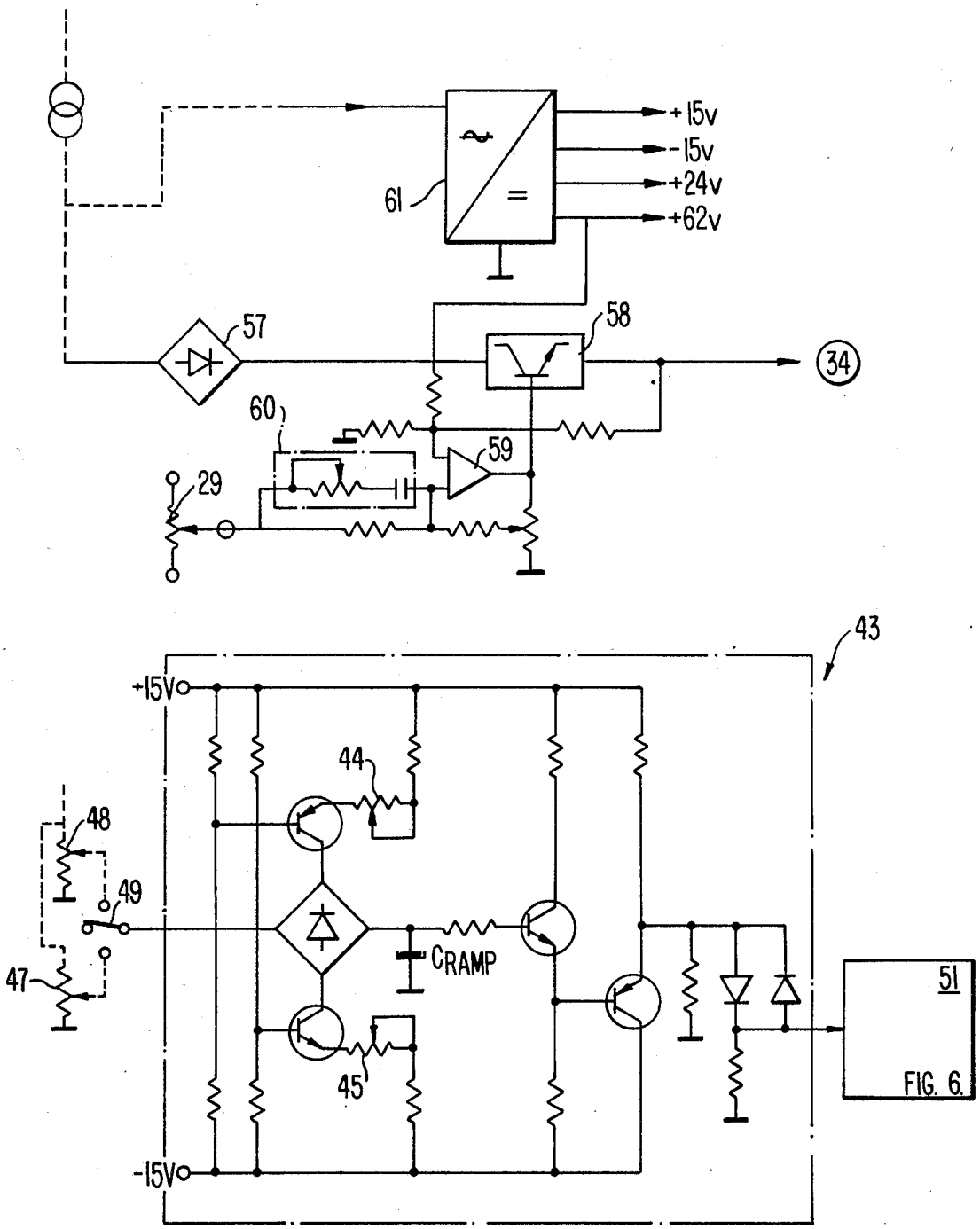
FIG. 5 is a block diagram of the control card.

Referring to the aforementioned drawings, the machine for continuously perforating very wide paper consists of a bed 1 which supports two rigid holders 2, which have been integrally formed with bed 1 so as to obtain a perfect alignment of the mechanisms supported by them.

A reduction gear means 3 for a direct current motor drives a drag shaft 4, which is connected to winding mandrel 5, which is supported at the opposite end by means of a retractable fastening mechanism 6 to make it possible to remove the mandrel. A flexing compensation device 7 is formed by a roller 8, mounted on a pivoted arm 9 which is pressed against the mandrel by weights 10 connected to the arm 9 by a cable or the like.

The paper 11 wound on the mandrel 5 fed from a precision machined antiskid roller 12 past mating driven perforator heads 14, having cooperating perforating punches and sockets, and which are driven from roller 12 through gears 13. The shaft of the roller 12 is provided with a tiny magnet 15, which excites a Hall effect sensor 16 that acts as a revolution counter.

A manual brake 17, positioned between perforating heads 14 and winding mandrel 5 and operable by means of a lever 18, presses the perforated paper 11 against a brake roll **17*a* to hold the paper when the paper is to be stopped while a roll of perforated paper is removed and another mandrel 5** is placed in position to receive a new roll.

An end-of-paper signalling device 19 is provided at brake roll **17*a* and contains an electromagnet 20 which actuates a ball point pen or letterer 21** to mark the paper at the desired length.

Two stamping rollers 22, connected together by a shaft 23 for synchronization, carry rubber stamps which are inked by pads 24. Said rollers roll on the paper as it passes over idler roll **22*a* between antiskid roller 12 and perforating heads 14. Rollers 22 are mounted on arms 25*a* connected to shaft 25*b*. An arm 25 is connected to shaft 25*b* and can be moved to turn shaft 25*b* to pivot rollers 22 away from idler roll 22*a***.

Two tension rollers 26 engage the paper up-stream of antiskid roller 12 to keep the tension of the paper constant. These are mounted to the arms 27 pivoted in the shaft 28. On the end of shaft 28 is an angular position detector 29.

The feed roll 30 is mounted on a shaft 31 secured by the adjustable locators. Said shaft 31 is connected to the shaft 33 of an electric brake 34 which controls the unwinding by friction.

All of the control and signalling elements are accessible to the user, and these are located in the upper part of a control desk. The control and power components are contained therein and are placed on a mounting plate.

The equipment is turned on by means of a main switch 35, and its energization is signalled by means of a "power on" equipment pilot light 36; the feeding of power to the brake 34 is controlled by means of the switch 37, and its energization is signalled by means of the pilot light 38; the feeding of power to the control stage 51 of the motor is controlled by means of a contactor 62 that is actuated by means of a start pushbutton 63, and its energization is signalled by means of the pilot light 39; the motor shutdown is carried out by means of an emergency stop pushbutton 100. As general protection, the equipment is provided with fuses 40 located on the mounting plate.

The system has two counters with preselection controls. The counter 41 controls the end-of-paper signalling device 19. The counter 42 for the motor determines when the paper has reached its preset length.

The starts and stops of the machine are carried out smoothly by means of an acceleration and deccleration ramp circuit 43 in order to avoid tearing of the paper. The acceleration and deceleration times are independently adjustable by means of the potentiometers 44 and 45 in conjunction with capacitor $C_{RAMP}$ and the other series resistances and the ramp circuit is situated on the control card 46.

The speed that can be attained by the motor winding is fixed by means of the potentiometers 47 and 48.

The speed is controlled by the potentiometer 47 up to its maximum and is controlled by the potentiometer 48 up to 30 percent of its maximum speed; the switch 49 permits the selection of the control potentiometer to be used during operation; a selector 50 selects whether the machine is to wind or unwind the paper by selecting the polarity of the voltage applied to the potentiometer 47 and 48.

In the control stage 51, the following parameters are controlled.

Maximum current by potentiometer 52.

Average current by potentiometer 53.

Feedback voltage by potentiometer 56.

Compensation rI by potentiometer 55.

Figure 6:
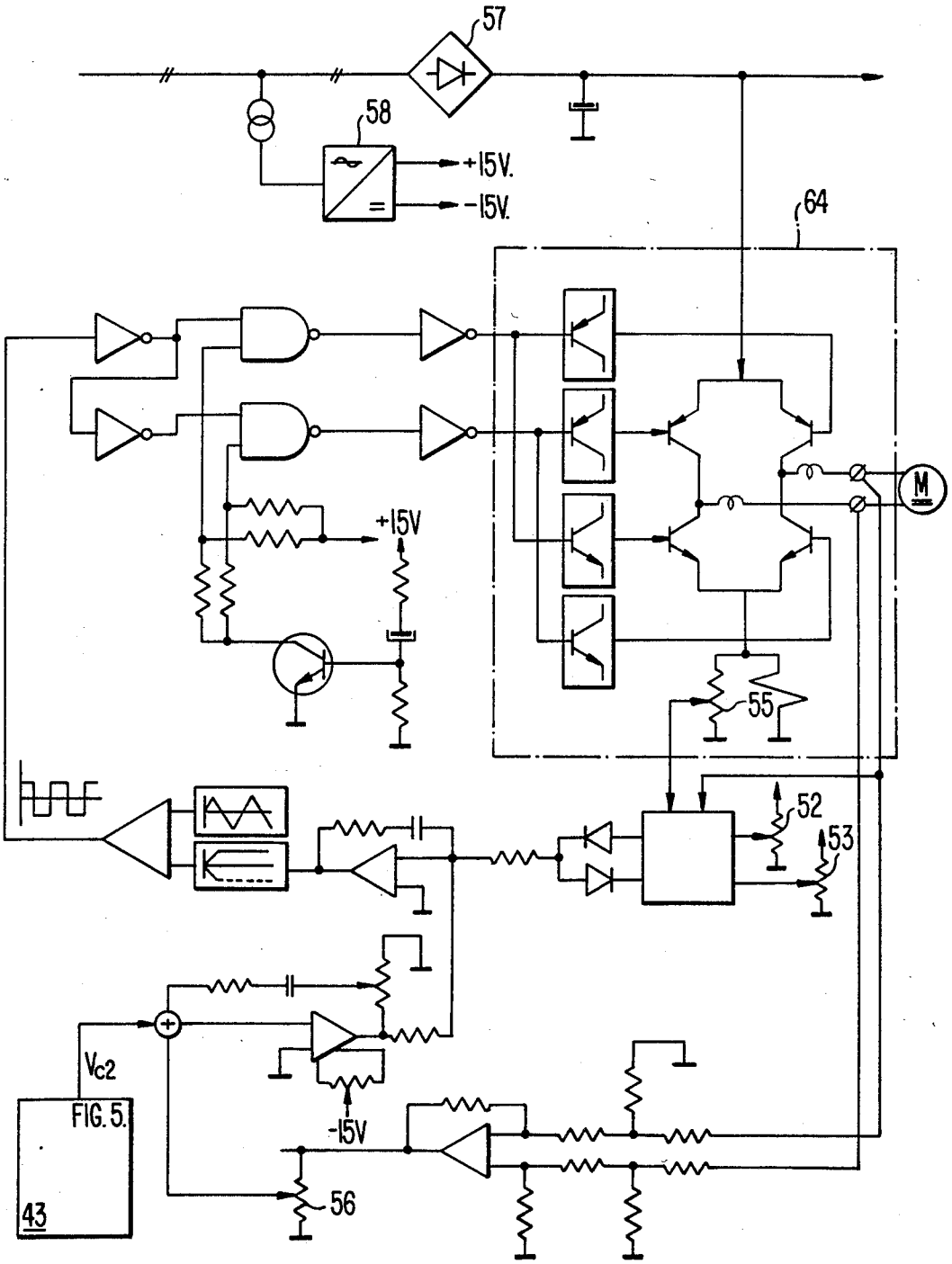
FIG. 6 is a block diagram of the control module of the motor.

The control stage 51 consists of a power supply 57, some auxiliary power supplies 58, a transitory switching stage 64 and a regulation and control circuit containing elements illustrated in FIG. 6.

Power supplied to the brake 34 is controlled by means of a pair of transistorized series regulation sources, 57 and 58, and controlled by means of an operational amplifier circuit 59 with a phase feed circuit 60 to offset the delay in the current risetime due to the inductance of the brake 34 and due to the mechanical inertia thereof.

Other stabilized voltages are provided by the power supply 61.

The contactor 62 carries out electromechanically the start and end of the winding and reset operations.

Although certain preferred embodiments of the invention have been herein described in order to illustrate the principles of the invention, it will be understood that certain modifications in structure can be effected without departing from the principles stated in the foregoing paragraphs.

I claim:

1. A perforating machine for continuously perforating wide paper comprising:

a pair of lateral holders for supporting all of the elements of said machine so as to thereby insure the exact positioning thereof;

a means for actuating a plurality of perforator heads in response to movement of said paper through a precision mechanized anti-skid roller;

a tension control means for controlling the tension of said paper, said control means having swinging rollers whose movement is detected by a sensor and further having an electromagnet brake for controlling the tension of said paper by controlling the unwinding of a feed roller of said paper;

a means for winding said perforated paper including an electronically controlled direct current motor, said means for winding being arranged so as to cause said direct current motor to smoothly start and stop;

a paper flexing compensation means operatively connected to a winding mandrel for winding said perforated paper, said paper flexing compensation means compensating for flexing of said paper;

a brake means for cutting and separating said perforated paper without jamming or misaligning said paper;

a rotation detector operatively connected to said anti-skid roller and having a counter means with a manually adjustable selector for stopping said direct current motor when said perforated roll of paper is of a length equal to a preset length which has been manually set by said adjustable selector;

an end of paper marking means including a means for measuring the length of said paper and for making a lateral line on said paper at a preset length corresponding to a value set by its manually adjustable selector, said lateral line corresponding to an end of paper warning;

an additional paper marking means including a rubber stamp carrier roller and an inking pad means for marking another lateral line on said paper during each rotation of said anti-skid roller.

* * * * *